US008497831B2

(12) United States Patent
Ito

(10) Patent No.: US 8,497,831 B2
(45) Date of Patent: Jul. 30, 2013

(54) ELECTRO-OPTICAL DEVICE, DRIVING METHOD THEREFOR, AND ELECTRONIC APPARATUS

(75) Inventor: Akihiko Ito, Tatsuno-cho (JP)

(73) Assignee: Seiko Epson Corporation, Tokyo (JP)

( * ) Notice: Subject to any disclaimer, the term of this patent is extended or adjusted under 35 U.S.C. 154(b) by 1795 days.

(21) Appl. No.: 11/534,948

(22) Filed: Sep. 25, 2006

(65) Prior Publication Data

US 2007/0075960 A1 Apr. 5, 2007

(30) Foreign Application Priority Data

Oct. 3, 2005 (JP) ..... 2005-289665
Jun. 16, 2006 (JP) ..... 2006-167032

(51) Int. Cl.
*G09G 3/36* (2006.01)

(52) U.S. Cl.
USPC ..... 345/100; 345/87; 345/204; 345/205

(58) Field of Classification Search
USPC ..... 345/100, 87, 204–205
See application file for complete search history.

(56) References Cited

U.S. PATENT DOCUMENTS

| | | | | |
|---|---|---|---|---|
| 4,795,239 | A | 1/1989 | Yamashita et al. | |
| 7,098,885 | B2 | 8/2006 | Kumada et al. | |
| 7,176,866 | B2 * | 2/2007 | Teraishi | 345/87 |
| 2003/0080934 | A1 * | 5/2003 | Ishiyama | 345/100 |
| 2004/0160404 | A1 | 8/2004 | Nakajima et al. | |

FOREIGN PATENT DOCUMENTS

| | | |
|---|---|---|
| JP | A 62-49399 | 3/1987 |
| JP | A-6-149180 | 5/1994 |
| JP | A-2002-311926 | 10/2002 |
| JP | A-2003-302951 | 10/2003 |
| JP | A-2003-323160 | 11/2003 |
| TW | 200307897 | 12/2003 |
| TW | I233082 (B) | 5/2005 |

* cited by examiner

*Primary Examiner* — William Boddie
*Assistant Examiner* — Leonid Shapiro
(74) *Attorney, Agent, or Firm* — Oliff & Berridge, PLC

(57) ABSTRACT

An electro-optical device includes pixel electrodes corresponding to intersections of a plurality of scanning lines and a plurality of data lines and specific to the pixels, a common electrode facing the pixel electrode, and a switching element that establishes conduction between the data line and the pixel electrode when a selection voltage is applied to the scanning line, a control circuit that supplies a high voltage having a predetermined value and a low voltage lower than the high voltage alternately at predetermined intervals to the common electrode; a scanning line driving circuit that selects the plurality of scanning lines in a predetermined order and that applies the selection voltage to each of the selected scanning lines; and a data line driving circuit that supplies a data signal defining the grayscale levels of the pixels to the data lines in a period during which one of the scanning lines is selected and during which the voltage applied to the common electrode is maintained at the high voltage or the low voltage and that performs a precharge operation for precharging the plurality of data lines to a predetermined potential in a period of time including a period during which the voltage applied to the common electrode changes from one of the high voltage and the low voltage to the other.

7 Claims, 11 Drawing Sheets

ELECTRO-OPTICAL DEVICE, DRIVING METHOD THEREFOR, AND ELECTRONIC APPARATUS

BACKGROUND

1. Technical Field

The present invention relates to techniques for simplifying the structure of electro-optical devices such as liquid crystal display devices.

2. Related Art

In an electro-optical device for performing display using electro-optical changes, such as a liquid crystal device, pixels are provided at intersections of scanning lines (gate lines) and data lines (source lines). Each of the pixels generally includes a capacitor holding an electro-optical material, such as liquid crystal, between a pixel electrode and a common electrode having a constant potential, and a switching element that establishes conduction between the data line and the pixel electrode when the scanning line is selected. The grayscale level (or brightness) of each pixel is determined by an effective voltage value stored in the capacitor. In a case where liquid crystal is used as the electro-optical material, the pixels are basically alternating-current driven, and a data signal designates a voltage for a range of grayscale values from the highest grayscale value to the lowest grayscale value on the high-level (or positive-polarity) side with respect to a reference potential, and a voltage for a range of grayscale values from the highest grayscale value to the lowest grayscale value on the low-level (or negative-polarity) side with respect to the reference potential.

A technique in which high and low voltages are alternately applied at certain intervals, such as every horizontal scanning period, to a common electrode to narrow the voltage range of a data signal, thereby achieving simplification of a circuit for driving data lines has been proposed (see, for example, JP-A-62-49399).

Although the technique allows simplification of a circuit for driving data lines, there arises another problem in that a wider voltage range may be required for switching elements of pixels and a scanning line circuit for driving scanning lines.

SUMMARY

An advantage of the invention is that it provides a technique for alternately applying high and low voltages to a common electrode, and more specifically, it provides an electro-optical device in which the voltage range required for switching elements of pixels and a circuit for driving scanning lines can be reduced, a driving method for the electro-optical device, and an electronic apparatus.

According to an aspect of the invention, an electro-optical device includes pixel electrodes corresponding to intersections of a plurality of scanning lines and a plurality of data lines and specific to the pixels, a common electrode facing the pixel electrode, and a switching element that establishes conduction between the data line and the pixel electrode when a selection voltage is applied to the scanning line, a control circuit that supplies a high voltage having a predetermined value and a low voltage lower than the high voltage alternately at predetermined intervals to the common electrode; a scanning line driving circuit that selects the plurality of scanning lines in a predetermined order and that applies the selection voltage to each of the selected scanning lines; and a data line driving circuit that supplies a data signal defining the grayscale levels of the pixels to the data lines in a period during which one of the scanning lines is selected and during which the voltage applied to the common electrode is maintained at the high voltage or the low voltage and that performs a precharge operation for precharging the plurality of data lines to a predetermined potential in a period of time including a period during which the voltage applied to the common electrode changes from one of the high voltage and the low voltage to the other. According to the aspect of the invention, the characteristic requirements for switching elements of pixels and a circuit for driving scanning lines can be reduced.

In this case, the precharge operation may begin and end in the period during which the voltage applied to the common electrode changes from the one of the high voltage and the low voltage to the other. Alternatively, the precharge operation may begin in the period during which the voltage applied to the common electrode changes from the one of the high voltage and the low voltage to the other, and the precharge operation may end in a period during which the voltage applied to the common electrode is maintained constant at the other of the high voltage and the low voltage. Still alternatively, the precharge operation may begin in a period in which the voltage applied to the common electrode is maintained constant at the one of the high voltage and the low voltage, and the precharge operation may end in the period during which the voltage applied to the common electrode changes from the one of the high voltage and the low voltage to the other.

In the electro-optical device, the precharge operation may begin and end in a period during which the selection voltage is applied to the scanning line.

The invention can be conceptualized as providing not only an electro-optical device but also a driving method for the electro-optical device and an electronic apparatus including the electro-optical device.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
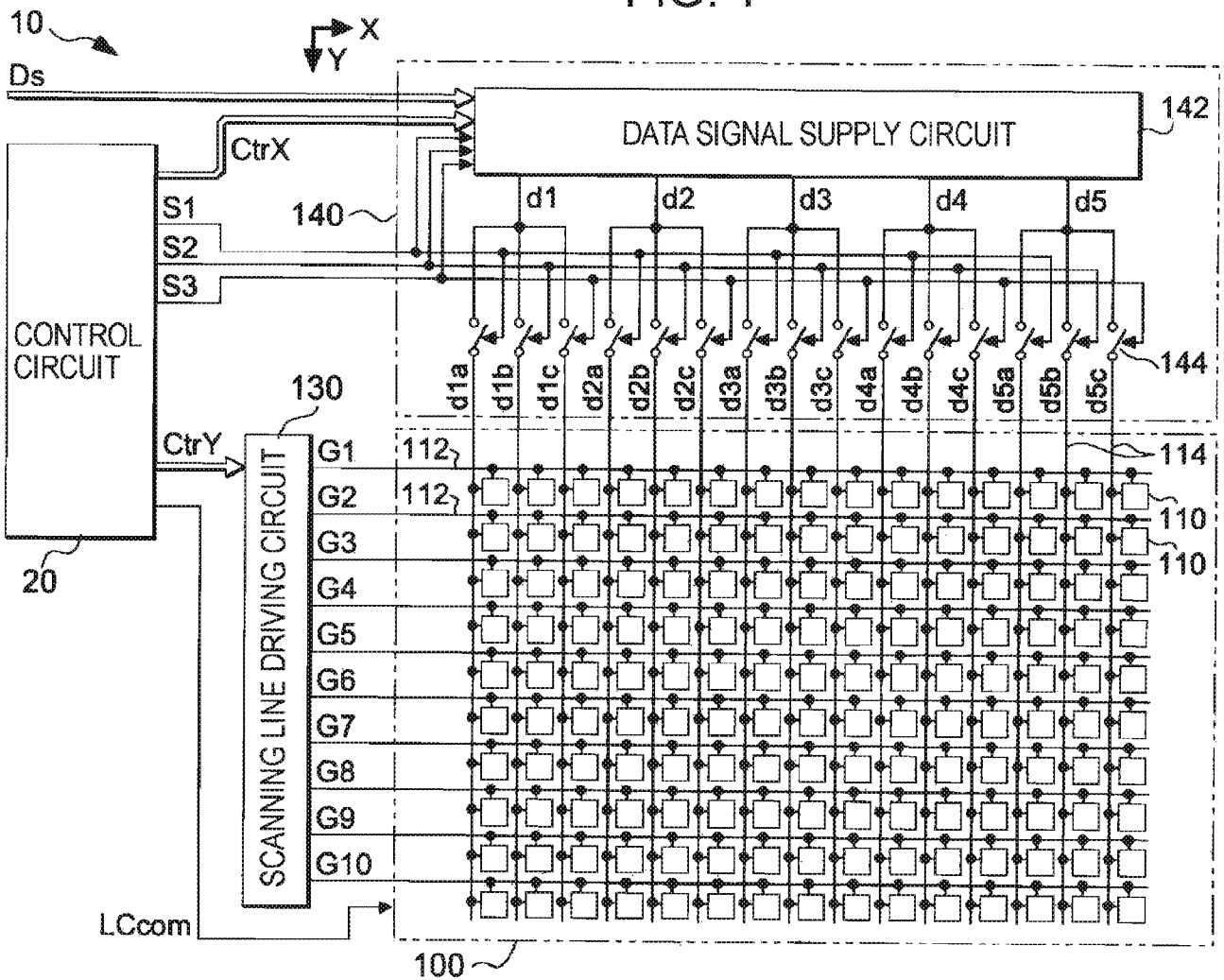
FIG. 1 is a block diagram showing a structure of an electro-optical device according to an embodiment of the invention.

An embodiment of the invention will be described with reference to the drawings. FIG. 1 is a block diagram showing a structure of an electro-optical device 10 according to an embodiment of the invention.

As shown in FIG. 1, the electro-optical device 10 includes a control circuit 20, a display area 100, a scanning line driving circuit 130, and a data line driving circuit 140. In the display area 100, 10 scanning lines 112 arranged in rows extend in the row direction (X-direction), and 15 data lines 114 arranged in columns extend in the column direction (Y-direction).

Pixels 110 are placed at intersections of the 10 scanning lines 112 and the 15 data lines 114. In the embodiment, therefore, the pixels 110 are arranged in a matrix of 10 vertical rows and 15 horizontal columns. However, it is to be understood that the invention is not limited to that arrangement.

Figure 2:
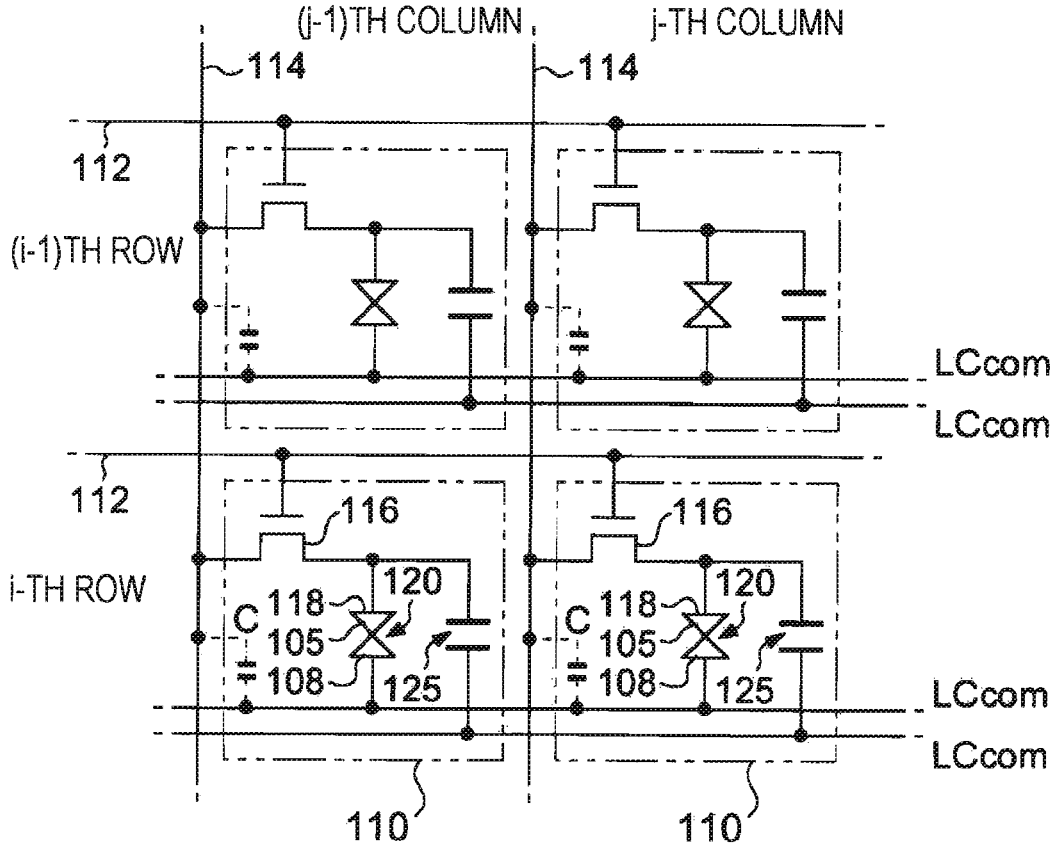
FIG. 2 is a diagram showing a structure of a pixel in the electro-optical device.

The structure of the pixels 110 will be described. FIG. 2 illustrates an electrical structure of the pixels 110. In FIG. 2, an array of two pixels and two pixels, i.e., a total of four pixels, is illustrated. The four pixels are arranged at intersections of an i-th row and an (i−1)th row adjacent thereto, which is one row above the i-th row, and a j-th column and a (j−1)th column adjacent thereto, which is one column to the left of the j-th column.

The (i−1)th and i-th rows generally represent rows in which the pixels 110 are arranged, where (i−1) and i denote integers ranging from 1 to 10. The (j−1)th and j-th columns generally represent columns in which the pixels 110 are arranged, where (j−1) and j denote integers ranging from 1 to 15.

As shown in FIG. 2, each of the pixels 110 functions as a switching element, and includes an n-channel thin-film transistor (TFT) 116 and a liquid crystal capacitor 120.

The pixels 110 are configured in the same manner, and the following description will be given in the context of the pixel 110 in the i-th row and the j-th column, by way of example. In the pixel 110 in the i-th row and the j-th column, the TFT 116 has a gate connected to the scanning line 112 of the i-th row, a source connected to the data line 114 of the j-th column, and a drain connected to a pixel electrode 118 at one end of the liquid crystal capacitor 120.

A common electrode 108 is disposed at the other end of the liquid crystal capacitor 120. A signal LCcom that is common to all of the pixels 110, described below, is supplied to the common electrode 108.

Although not specifically illustrated, the display area 100 is formed of a pair of substrates, namely, an element substrate and a counter substrate, which are bonded to each other with a predetermined gap therebetween, and a liquid crystal is held between the substrates. The scanning lines 112, the data lines 114, the TFTs 116, and the pixel electrodes 118 are defined on the element substrate, and the common electrodes 108 are defined on the counter substrate. The surfaces of the element substrate and the counter substrate on which the electrodes are defined are bonded so as to face each other.

In the embodiment, the liquid crystal capacitors 120 are formed of the pixel electrodes 118 and the common electrodes 108 facing each other with liquid crystals 105 therebetween.

The pixel electrodes 118, as well as the data lines 114 of the individual columns, face the common electrodes 108 with the liquid crystals 105 therebetween. Parasitic capacitors C are thus formed, as indicated by broken lines in FIG. 2.

The element substrate and the counter substrate include alignment layers on the facing surfaces thereof. The alignment layers are rubbed so that, for example, liquid crystal molecules are continuously twisted approximately 90 degrees in the longitudinal direction between the substrates. On the rear surfaces of the substrates, there are defined polarizers along the alignment direction.

Light passing between the pixel electrode 18 and the common electrode 108 is optically rotated approximately 90 degrees along the twisted liquid crystal molecules when an effective voltage value stored in the liquid crystal capacitor 120 is zero. As the effective voltage value increases, the liquid crystal molecules are inclined in the electric field direction, resulting in the removal of the optical rotation property. For example, in a transmissive display area, polarizers are placed on the light-incoming side and the rear side so that the polarizing axes of the polarizers coincide with the alignment direction. In this case, when the effective voltage value approaches zero, the optical transmittance becomes maximum so that white is displayed whereas, when the effective voltage value increases, the amount of transmitted light is reduced, and the transmittance finally becomes minimum so that black is displayed (normally white mode).

A selection voltage is applied to the scanning line 112 to turn on the TFT 116 (so as to be brought into conduction), and a higher (positive) or lower (negative) voltage than the voltage on the common electrode 108 by a voltage corresponding to a target grayscale level (or brightness) is applied to the pixel electrode 118 via the data line 114 and the turned on TFT 116. Therefore, the effective voltage value stored in the liquid crystal capacitor 120 can be controlled depending on the grayscale level.

When a non-selection voltage is applied to the scanning line 112, the TFT 116 is turned off (so as to be brought into non-conduction). Since the off resistance is not ideally infinite at that time, the charge leaks from the liquid crystal capacitor 120 to some extent. In order to mitigate the effect of the off leakage, a storage capacitor 125 is provided for each of the pixels 110. One end of the storage capacitor 125 is connected to the pixel electrode 118 (and the drain of the TFT 116). The other end of the storage capacitor 125 is common to all pixels, and is electrically connected to the common electrode 108.

Referring back to FIG. 1, the control circuit 20 has a first function for scanning the display area 100 vertically with respect to the scanning line driving circuit 130 and horizontally with respect to the data line driving circuit 140; a second function for controlling the selection of blocks, described below, during the horizontal scanning; and a third function for supplying the signal Lccom to the common electrodes 108 in such a manner that the signal LCcom is alternately switched between a low voltage and a high voltage.

In the first function, the control circuit 20 generates and outputs a control signal CtrY for vertically scanning the display area 100 and a control signal CtrX for horizontally scanning the display area 100 in synchronization with image data Ds supplied from an external upper-level device (not shown). The image data Ds is digital data specifying the brightness (or grayscale levels) of the pixels 110, and is supplied from the external upper-level device in the order in which the array of 10 vertical rows and 15 horizontal columns are vertically and horizontally scanned over one vertical scanning period (1F).

In the second function, the control circuit 20 outputs signals S1, S2, and S3 for sequentially selecting blocks and precharging the 15 data lines 114 during the horizontal scanning in accordance with the control signal CtrX.

Figure 4:
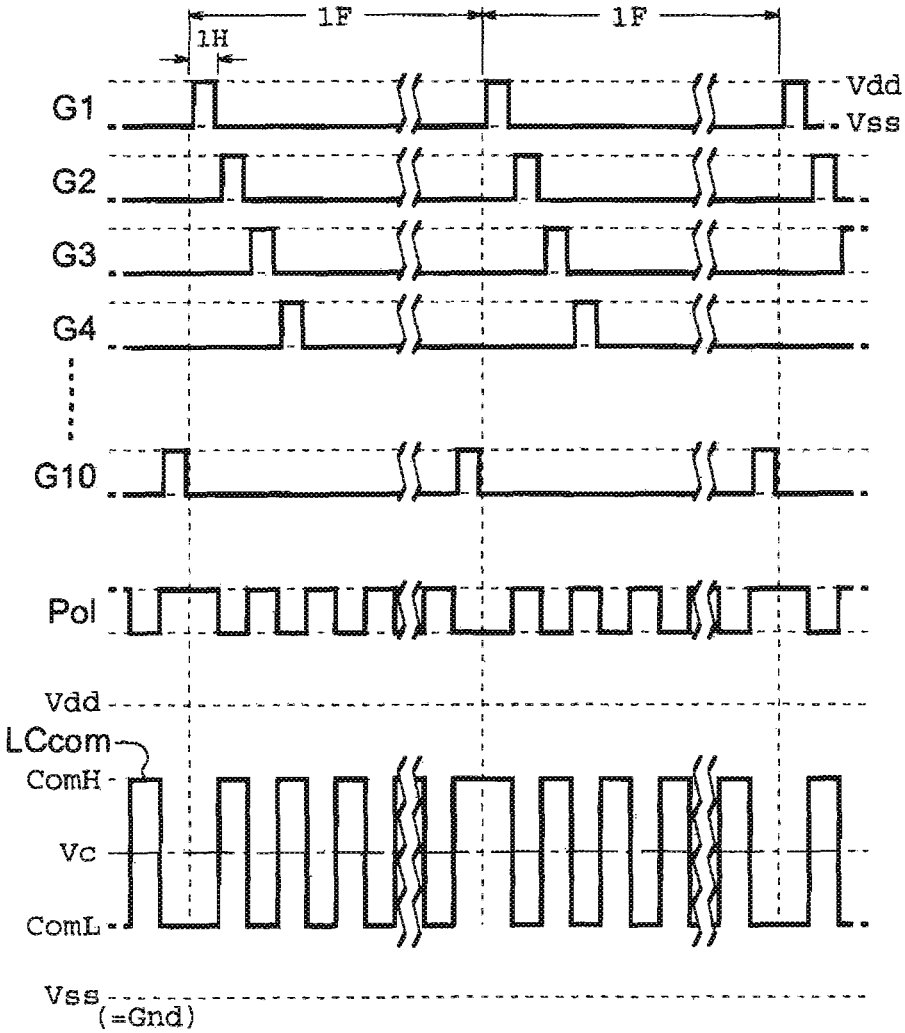
FIG. 4 is a diagram showing scanning signals and other signals in the electro-optical device.

The control signal CtrX includes a signal Pol specifying the writing polarity to the liquid crystal capacitors 120. Specifically, for example, the signal Pol specifies a positive writing in which the voltage on the pixel electrode 118 is higher than the voltage on the common electrode 108 when the signal Pol is at a high level, and specifies a negative writing in which the voltage on the pixel electrode 118 is lower than the voltage on the common electrode 108 when the signal Pol is at a low level. As shown in FIG. 4, within a given vertical scanning period (1F), the level of the signal Pol is inverted every horizontal scanning period (1H). In the embodiment, therefore, the writing polarity to the liquid crystal capacitors 120 is inverted every scanning line, called row inversion. When focusing on the same one horizontal scanning period (1H), the level of the signal Pol is inverted between two adjacent vertical scanning periods. In the embodiment, therefore, when focusing on the same liquid crystal capacitor 120, the writing polarity is inverted every vertical scanning period (1F). The writing polarity of the liquid crystal capacitors 120 is inverted in order to prevent a degradation of the liquid crystals 105 due to the application of the direct-current component.

Figure 5:
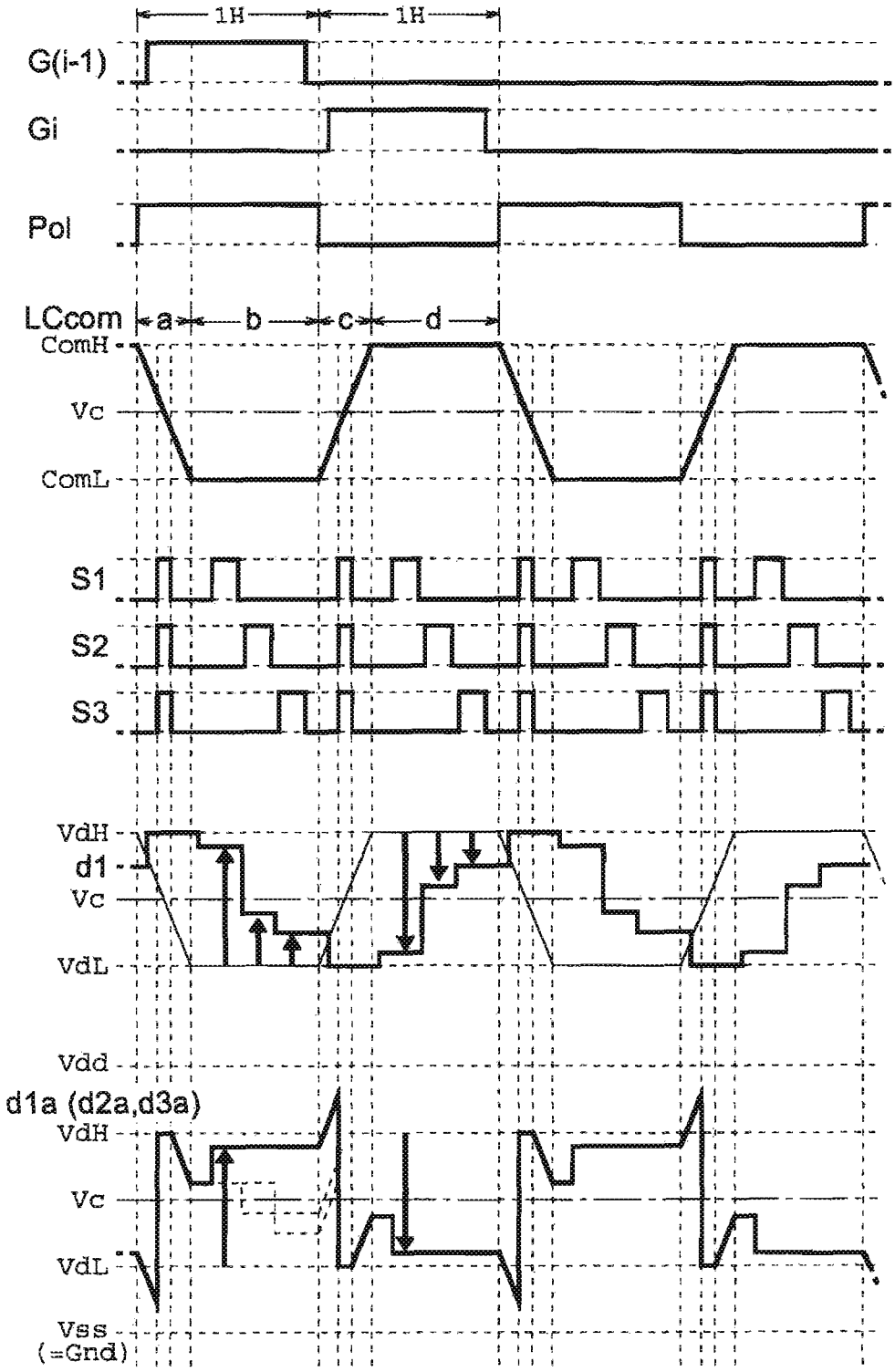
FIG. 5 is a diagram showing voltage waveforms of the individual components of the electro-optical device.

The third function will be described in detail. As shown in FIG. 5, the control circuit 20 controls the voltage applied to the common electrode 108 in the following manner. That is, within a horizontal scanning period (1H) in which the signal Pol is set to the high level to specify a positive writing, a voltage decreasing from a voltage ComH to a voltage ComL is applied in a period a starting from the beginning of that horizontal scanning period, and a voltage maintained constant at the voltage ComL is applied in a period b within a horizontal scanning period (1H) in which the signal Pol is set to the low level to specify a negative writing, a voltage increasing from the voltage ComL to the voltage ComH is applied in a period c starting from the beginning of that horizontal scanning period, and a voltage maintained constant at the voltage ComH is applied in a period d. In the embodiment, the voltages ComL and ComH are symmetrical with respect to a voltage Vc, which is equal to one half of a power supply voltage Vdd. The voltage ComL is set to one half of the voltage Vc, and the voltage ComH is set to the middle of the power supply voltage Vdd and the voltage Vc.

In the embodiment, there are two cases. In a first case, when an ideal square wave (see FIG. 4) is applied to the common electrode 108, as a result, the voltage on the common electrode 108 has a round waveform, as shown in FIG. 5, because the common electrode 108 has a resistance and the parasitic capacitance C is formed. In a second case, the signal LCcom whose waveform is rounded on purpose so as to form ramp waveforms in the periods a and c is applied to the common electrode 108 that is in an ideal state. In the embodiment, in either case, the common electrode 108 has a voltage changing from one of the voltages ComL and ComH to the other not immediately but gradually over the periods a and c.

the embodiment, the control circuit 20 sets the signals S1, S2, and S3 to a high level at the same time in the periods a and c to precharge all of the data lines 114, as described below.

In FIGS. 4 and 5, for the convenience of illustration, vertical voltage scales differ between the signals treated as logical signals, such as scanning signals G1, G2, . . . , and G10 and the signals SI, and the other voltage waveforms (the same applies to FIGS. 6 to 9 below).

The scanning line driving circuit 130 vertically scans the scanning lines 112 of the first, second, third, . . . , and tenth rows according to the control signal CtrY, and supplies the scanning signals G1, G2, G3, . . . , and G10 in accordance with the vertical scanning. Specifically, as shown in FIG. 4, the scanning line driving circuit 130 sequentially selects the scanning lines 112 of the first, second, third, . . . , and tenth rows every horizontal scanning period (1H) within a vertical scanning period (1F), and sets a scanning signal corresponding to each of the selected scanning lines 112 to a high level, namely, a selection voltage Vdd, for a shorter period of time than that horizontal scanning period (1H) while setting scanning signals corresponding to the remaining scanning lines 112 to a low level, namely, a non-selection voltage Vss. In practice, the non-selection voltage Vss is a ground potential Gnd (zero voltage), which is the voltage reference.

In the embodiment, as shown in FIG. 5, each of the scanning signals G1, G2, G3, . . . , and G10 is set to the high level in the period a or c before the signals S1, S2, and S3 are set to the high level at the same time.

Figure 3:
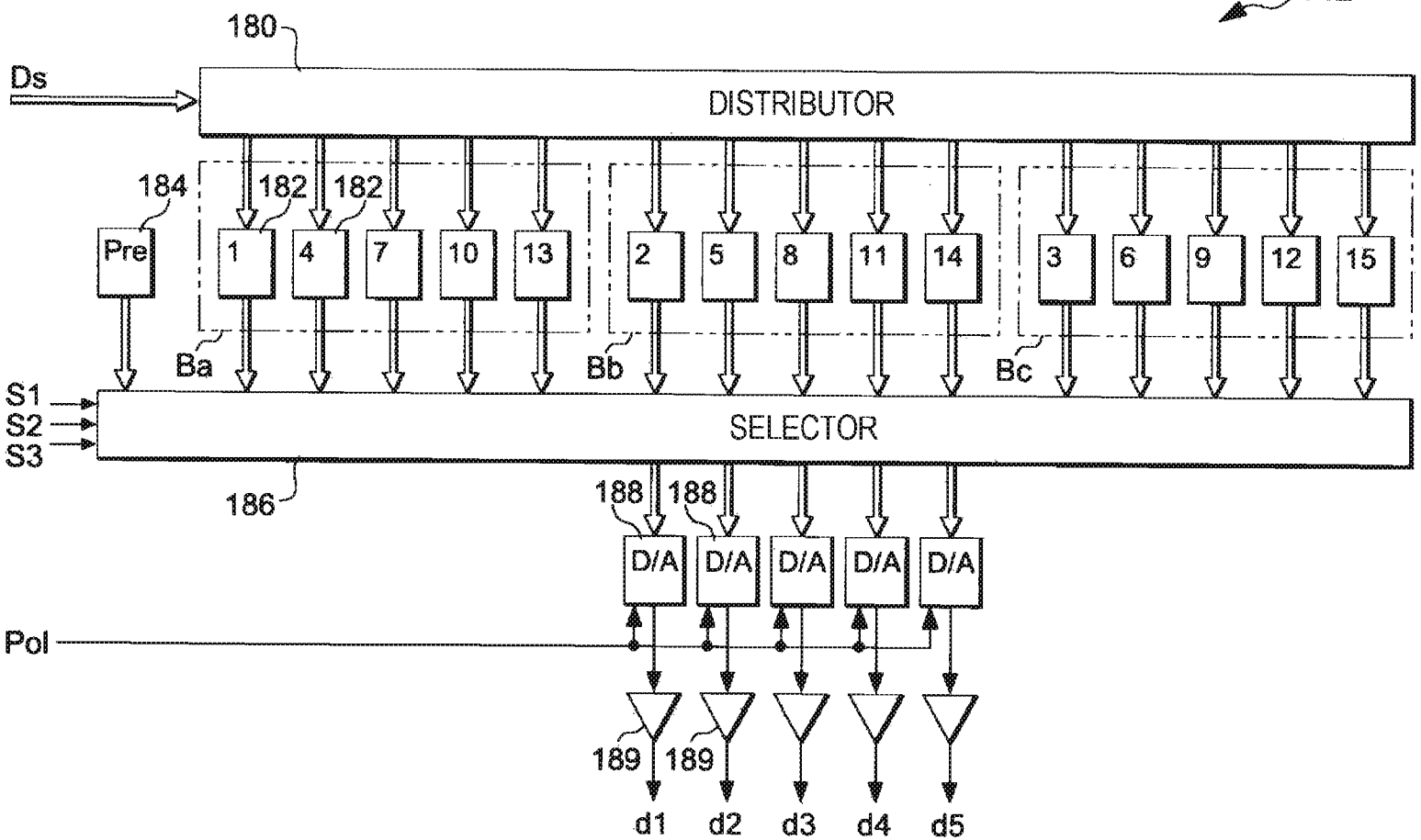
FIG. 3 is a diagram showing a structure of a data signal supply circuit in the electro-optical device.

The data line driving circuit 140 includes a data signal supply circuit 142 and switches 144, and each of the switches 144 is provided at an end of each of the data lines 114. The structure of the data signal supply circuit 142 will be described with reference to FIG. 3. As shown in FIG. 3, the data signal supply circuit 142 includes a distributor 180, latch circuits 182 and 184, a selector 186, digital-to-analog (D/A) converters 188, and buffer circuits 189.

The distributor 180 distributes one pixel row of image data Ds to the latch circuits 182 associated with the individual columns. The latch circuits 182 associated with the individual columns latch the distributed image data Ds. In the embodiment, every five columns of the latch circuits 182 are grouped into a block. Specifically, in the embodiment, since the number of data lines 114 is 15, the latch circuits 182 are grouped into three blocks, namely, blocks Ba, Bb, and Bc. The block Ba is formed of the latch circuits 182 corresponding to the data lines 114 of the First, fourth, seventh, tenth, and 13th columns from the leftmost column in FIG. 1; the block Bb is formed of the latch circuits 182 corresponding to the data lines 114 of the second, fifth, eighth, 11th, and 14th columns; and the block Bc is formed of the latch circuits 182 corresponding to the data lines 114 of the third, sixth, ninth, 12th, and 15th columns.

The latch circuit 184 continuously latches data defining a precharge voltage, which is supplied by a control circuit (not shown) immediately after the power supply is turned on, until the power supply is turned off. In the embodiment, the data defining a precharge voltage may be image data specifying the darkest grayscale in the normally white mode.

The selector 186 selects the latch circuits 182 or the latch circuit 184 according to the signals S1, S2, and S3. Specifically, the selector 186 selects the latch circuits 182 belonging to the block Ba when only the signal S1 is at the high level; the latch circuits 182 belonging to the block Bb when only the signal S2 is at the high level; and the latch circuits 189 belonging to the block Bc when only the signal S3 is at the high level, and outputs the image data Ds for the five columns latched by the selected latch circuits 182.

When all of the signals S1, S2, and S3 are at the high level, the selector 186 selects the latch circuit 184, and distributes and outputs the data latched by the latch circuit 184 in common for the five columns.

The D/A converters 188 are individually provided for five columns in association with the outputs of the selector 186. Each of the D/A converters 188 converts the image data Ds output from the selector 186 into an analog voltage that is higher than the voltage ComL by a voltage corresponding to a grayscale level specified by the image data Ds if the signal Pol specifies a positive polarity, and into an analog voltage that is lower than the voltage ComH by a voltage corresponding to a grayscale level specified by the image data Ds if the signal Pol specifies a negative polarity.

The buffer circuits 189 are individually provided for five columns in association with the outputs of the D/A converters 188. Each of the buffer circuits 189 reduces the output impedance of the analog voltage signal converted by the D/A converter 188, and outputs the resulting signal as a data signal to be given by the data signal supply circuit 142. A data signal d1 is generated based on the image data Ds latched by the latch circuit 182 for the first, second, or third column. A data signal d2 is generated based on the image data Ds latched by the latch circuit 182 for the fourth, fifth, or sixth column; a data signal d3 is generated based on the image data Ds latched by the latch circuit 182 for the seventh, eighth, or ninth column; a data signal d4 is generated based on the image data Ds latched by the latch circuit 182 for the 10th, 11th, or 12th column; and a data signal d5 is generated based on the image data Ds latched by the latch circuit 182 for the 13th, 14th, or 15th column.

As shown in FIG. 1, the data lines 114 of the individual columns are connected to first ends of the switches 144. Second ends of every three columns of the switches 144 from the leftmost are connected to a common node. In the embodiment, since the number of columns is 15, the number of common nodes of the second ends of the switches 144 is five. The data signals d1, d2, d3, d4, and d5 are supplied to these nodes in order from the leftmost by the data signal supply circuit 142. The switches 144 associated with the first, fourth, seventh, tenth, and 13th columns are turned on when the signal S1 is set to the high Level, the switches 144 associated with the second, fifth, eighth, 11th, and 14th columns are turned on when the signal S2 is set to the high level, and the switches 144 associated with the third, sixth, ninth, 12th, and 15th columns are turned on when the signal S3 is set to the high level.

The data lines 114 associated with the turned off switches 144 are in a high-impedance state that leads to unstable voltage levels, and the voltages on the data signals may not match the voltages on the data lines. The voltages on the data lines 114 of the first, second, and third columns to which the data signal d1 is supplied are represented by d1*a*, d1*b*, and d1*c*, respectively. The voltages of the remaining data lines are also represented in the manner shown in FIG. 1.

The operation of the electro-optical device 10 according to the embodiment will now be described.

As shown in FIG. 4, the scanning line driving circuit 130 sequentially and exclusively sets the scanning signals G1, G2, G3, . . . , and G10 to a high level every horizontal scanning period. First, a horizontal scanning period during which the scanning signal G1 is at the high level will be described.

Before setting the scanning signal G1 to the high level, one row of pixel data Ds corresponding to the pixels 110 in the first row and the first through 15th columns is stored in the latch circuits 182 for the corresponding columns. Assuming that the signal Pol is set to the high level to specify a positive writing in that horizontal scanning period, as shown in FIG. 5, a voltage (LCcom) decreasing from the voltage ComH to the voltage ComL is applied to the common electrode 108 in the period a.

In the period a, when all of the signals S1, S2, and S3 are set to the high level, the selector 186 selects the data latched by the latch circuit 184, and distributes and outputs the selected data in common for the five columns. As described above, the data latched by the latch circuit 184 corresponds to image data specifying the darkest grayscale. Since a positive writing is specified, a voltage VdH corresponding to the darkest grayscale is output from the D/A converters 188 for the five columns.

In the period a, when the signals S1, S2, and S3 are set to the high level at the same time, all of the switches 144 are turned on. Thus, the data lines 114 are all precharged to the voltage VdH.

In the period a, when the signals S1, S2, and S3 set to the low level, all of the data lines 114 are brought into the high-impedance state. The voltage applied to the common electrode 108 decreases from the voltage ComH to the voltage ComL in the period a, and, due to the voltage change in the common electrode 108, the voltage on the high-impedance-state data lines 114 electrically coupled to the common electrode 108 via the capacitor C decreases from the voltage VdH. In this case, the voltages of all of the data lines 114 decrease in a similar manner, and the precharging effect is not impaired.

In FIG. 5, the voltage change in the data signal d1 among the data signals d1 to d5, and the change of the voltage d1*a* in the data line 114 of the first column among the data lines 114 of the first, second, and third columns to which the data signal d1 is distributed are illustrated by way of example.

In the period b, when the voltage applied to the common electrode 108 is maintained constant at the voltage ComL, there is no change in the voltages of the high-impedance-state data lines 114.

In the period b, first, the control circuit 20 sets the signal S1 to the high level. When only the signal S1 is at the high level, the selector 186 selects the latch circuits 182 belonging to the block Ba, and outputs the image data Ds for the first row and the first, fourth, seventh, tenth, and 13th columns that is latched by the selected latch circuits 182.

Since a positive writing is specified, a voltage that is higher than the voltage ComL by a voltage corresponding to a grayscale value specified by the image data Ds is output from the D/A converters 188 for the five columns. For example, in a period during which only the signal S1 is at the high level, the data signal d1 has a higher voltage than the voltage ComL by the voltage corresponding to the grayscale value specified by the image data Ds for the first row and the first column, as indicated by an up-arrow in FIG. 5. The remaining data signals d2, d3, d4, and d5 also have higher voltages than the voltage ComL by the voltages corresponding to the grayscale values specified by the image data Ds for the first row and the fourth column, the first row and the seventh column, the first row and the tenth column, and the first row and the 13th column.

In the period b, when only the signal S1 is at the high level, the switches 144 for the first, fourth, seventh, tenth, and 13th columns are turned on. Thus, the data signal d1 is supplied to the data line 114 of the first column, and the data signals d2, d3, d4, and d5 are further supplied to the data lines 114 of the fourth, seventh, tenth, and 13th columns, respectively.

In the period b, the scanning signal G1 is at the high level, and the TFTs 116 in the pixels 110 in the first row are turned on. Thus, the data signal d1 supplied to the data line 114 of the first column is applied to the pixel electrode 118 in the first row and the first column. This allows the difference between the voltage ComL on the common electrode 108 and the voltage on the data signal d1, that is, the voltage corresponding to the grayscale value specified by the image data Ds for the first row and the first column, to be written to the liquid crystal capacitor 120 in the first row and the first column. Likewise, the data signals d2, d3, d4, and d5 supplied to the data lines 114 of the fourth, seventh, tenth, and 13th columns are applied to the pixel electrodes 118 in the first row and the fourth column, the first row and the seventh column, the first row and the tenth column, and the first row and the 13th column. This allows the voltages corresponding to the grayscale values specified by the image data Ds for the first row and the fourth column, the first row and the seventh column, the first row and the tenth column and the first row and the 13th column to be written to the liquid crystal capacitors 120 in the first row and the fourth column, the first row and the seventh column, the first row and the tenth column, and the first row and the 13th column, respectively.

In the period b, then, the control circuit 20 sets only the signal S2 to the high level after setting the signal S1 to the low level. When the signal S1 is at the low level, the associated switches 144 are turned off so that the data lines 114 of the first, fourth, seventh, tenth, and 13th columns are brought into the high-impedance state, and the voltage levels of the data signals d1, d2, d3, d4, and d5 before the switches 144 are turned off are maintained. Meanwhile, when only the signal S2 is at the high level, the selector 186 selects the latch circuits 182 belonging to the block Bb, and outputs the image data Ds for the first row and the second, fifth, eighth, 11th, and 14th columns. Thus, the data signals d1, d2, d3, d4, and d5 have higher voltages than the voltage ComL by the voltages corresponding to the grayscale values specified by the image data Ds for the first row and the second column, the first row and the fifth column, the first row and the eighth column, the first row and the 11th column and the first row and the 14th column, respectively.

In the period b, when only the signal S2 is at the high level, the switches 144 for the second, fifth, eighth, 11th, and 14th columns are turned on to supply the data signals d1, d2, d3, d4, and d5 to the data lines 114 of the second, fifth, eighth, 11th, and 14th columns, respectively. Thus, the data signals d1, d2, d3, d4, and d5 are applied to the pixel electrodes 118 in the first row and the second column, the first row and the fifth column, the first row and the eighth column, the first row and the 11th column, and the first row and the 14th column, respectively, so that the voltages corresponding to the grayscale values specified by the image data Ds for the first row and the second column, the first row and the fifth column, the first row and the eighth column, the first row and the 11th column, and the first row and the 14th column are written to the liquid crystal capacitors 120 in the first row and the second column, the first row and the fifth column, the first row and the eighth column, the first row and the 11th column, and the first row and the 14th columns respectively.

In the period b, then, the control circuit 20 sets the signal S3 to the high level after setting the signal S2 to the low level. Then the signal S2 is at the low level, the associated switches 144 are turned off so that the data lines 114 of the second, fifth, eighth, 11th, and 14th columns are brought into the high-impedance state, and the voltage levels of the data signals d1, d2, d3, d4, and d5 before the switches 144 are turned off are maintained. Meanwhile, when only the signal S3 is at the high level, the selector 186 selects the latch circuits 182 belonging to the block Bc, and outputs the image data Ds for the first row and the third, sixth, ninth, 12th, and 15th columns. Thus, the data signals d1, d2, d3, d4, and d5 have higher voltages than the voltage ComL by the voltages corresponding to the grayscale values specified by the image data Ds for the first row and the third column, the first row and the sixth column, the first row and the ninth column, the first row and the 12th column, and the first row and the 15th column, respectively.

In the period b, when only the signal S3 is at the high level, the switches 144 for the third, sixth, ninth, 12th, and 15th columns are turned on to supply the data signals d1, d2, d3, d4, and d5 to the data lines 114 of the third, sixth, ninth, 12th, and 15th columns, respectively. Thus, the data signals d1, d2, d3, d4, and d5 are applied to the pixel electrodes 118 in the first row and the third column, the first row and the sixth column, the first row and the ninth column, the first row and the 12th column, and the first row and the 15th column, respectively, so that the voltages corresponding to the grayscale values specified by the image data Ds for the first row and the third column, the first row and the sixth column, the first row and the ninth column, the first row and the 12th column, and the first row and the 15th column are written to the liquid crystal capacitors 120 in the first row and the third column, the first row and the sixth column, the first row and the ninth column, the first row and the 12th column, and the first row and the 15th column, respectively.

Accordingly, the positive voltages in accordance with the grayscale levels specified by the image data Ds are completely written to the pixel electrodes 118 in the first row and the first through 15th columns. In parallel with the writing of the positive voltages, one row of pixel data Ds corresponding to the pixels 110 in the second row and the first through 15th columns is supplied to the distributor 180 from the supply device, and is then distributed to the latch circuits 182 that have output the first row of image data Ds. That is, when the writing to the pixels 110 in the first row is completely performed, one row of pixel data Ds corresponding to the subsequent pixels 110 in the second row and the first through 15th columns is stored in the individual latch circuits 182.

The control circuit 20 sets the signal S3 to the low level. When the signal S3 is at the low level, the associated switches 144 are turned off so that the data lines 114 of the third, sixth, ninth, 12th, and 15th columns are brought into the high-impedance state, and the voltage levels of the data signals d1, d2, d3, d4, and d5 before the switches 144 are turned off are maintained.

At that time, the data lines 114 of the first through 15th columns have voltages equal to the voltages written to the respective columns, that is, the voltages corresponding to the grayscale levels.

Next, a horizontal scanning period during which the scanning signal G2 is at the high level will be described.

Since a positive writing is specified in the period during which the scanning signal G1 is at the high level, the writing polarity is inverted in the period during which the scanning signal G2 Is at the high level, and a negative writing is specified. As shown in FIG. 5, a voltage increasing from the voltage ComL to the voltage ComH is applied to the common electrode 108 in the period c.

In the period c, the data lines 114 of the individual columns are in the high-impedance state until the signals S1, S2, and S3 are set to the high level at the same time. Thus, due to the voltage increase in the common electrode 108, the voltages of the data lines 114 uniformly increase from the voltage states corresponding to the grayscale levels of the pixels in the first row. The voltage d1*a* of the data line 114 of the first column, for example, increases from the voltage corresponding to the grayscale level of the pixel in the first row and the first column.

In the period c, when all of the signals S1, S2, and S3 are set to the high level, the selector 186 selects the data latched by the latch circuit 184, and distributes and outputs the selected data in common for the five columns. Since a negative writing is specified, a negative voltage vdL corresponding to the darkest grayscale is output from the D/A converters 188 for the five columns. Thus, the voltage states of all of the data lines 114 that have uniformly increased from the voltage states corresponding to the grayscale levels of the pixels are cleared, and the data lines 114 are all precharged to the voltage VdL.

In the period c, when the signals S1, S2, and S3 are set to the low level again, all of the data lines 114 are brought into the high-impedance state, and the voltages of the data lines 114 uniformly increase from the voltage VdL due to the voltage change in the common electrode 108. In this case, the voltages of all of the data lines 114 increase in a similar manner, and the precharging effect is not impaired.

In the period d, the voltage applied to the common electrode 108 is maintained constant at the voltage ComH, there is no change in the voltages of the high-impedance-state data lines 114. In the period d, as in the period b, the signals S1, S2, and S3 are sequentially and exclusively set to the high level, and the writing of the negative voltages in accordance with the grayscale levels specified by the image data Ds are completely written to the pixel electrodes 118 in the second row and the first through 15th columns.

Likewise, subsequently, a positive writing is performed for the pixels 110 in the odd-numbered rows, i.e. the third, fifth, seventh, and ninth rows, and a negative writing is performed for the pixels 110 in the even-numbered rows, i.e., the fourth, sixth, eighth, and tenth rows.

In the subsequent vertical scanning period, the writing polarity for the individual rows is inverted. Specifically, a negative writing is performed for the pixels 110 in the odd-numbered rows, and a positive writing is performed for the pixels 110 in the even-numbered rows. The writing polarity to the pixels 110 is inverted every vertical scanning period, thus preventing a degradation of the liquid crystals 105 caused by the application of the direct-current component.

In the embodiment, the data lines 114 are precharged in the periods a and c, i.e., a period during which the voltage applied to the common electrode 108 changes from one of the voltages ComL and ComH to the other. An advantage of this arrangement will be described with reference to FIG. 7 in the context of a problem with precharging the data lines 114 at the beginning of the periods b and d, rather than the periods a and c, that is, at the beginning of a period during which the voltage applied to the common electrode 108 is maintained constant at the voltage ComL or ComH.

Figure 7:
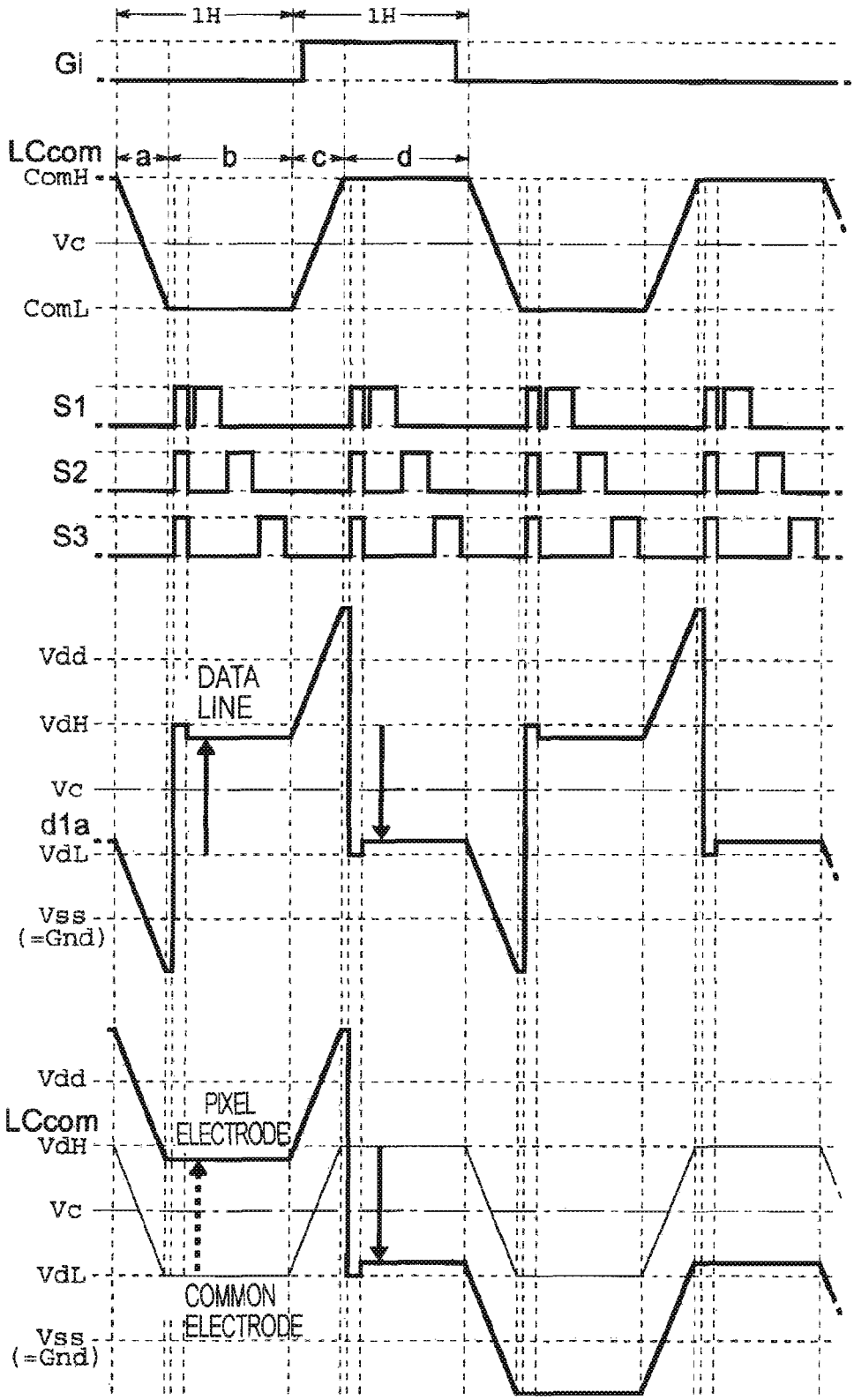
FIG. 7 is a diagram showing the voltage waveforms of the individual components in a comparative example.

FIG. 7 illustrates a change of the voltage d1*a* in the data line 114 of the first column, a voltage change in the pixel electrode 118 in the i-th row and the first column, and a voltage change in the common electrode 108 in an environment where the signals S1, S2, and S3 are set to the high level at the same time at the beginning of the periods b and d to precharge the data lines 114, when focusing on the pixel 110 in the i-th row and the first column and when, for example, a grayscale level close to black is specified for that pixel over a plurality of frames It is assumed herein that a positive writing is specified in the previous vertical scanning period and that a voltage higher than the voltage ComL by the voltage corresponding to that grayscale level is written to the pixel electrode 118 in the i-th row and the first column. In this case, the voltage on the pixel electrode 118 changes so as to maintain the difference between the written voltage and the voltage ComL, that is, the voltage stored in the liquid crystal capacitor 120, with respect to the voltage on the common electrode 108 until the scanning signal G1 is set to the high level and until the signal S1 is set to the high level (the off leakage of the TFT 116 is ignored for the sake of simplicity of illustration).

Since a negative writing is specified after a positive writing, the voltage applied to the common electrode 108 increases from the voltage ComL to the voltage ComH. In accordance with the voltage increase, the voltage on the pixel electrode 118 in the i-th row and the first column also increases. If the absolute value of the voltage stored in the liquid crystal capacitor 120 in the i-th row and the j-th column is large, that is, if a voltage corresponding to a dark grayscale in the normally white mode is stored, the potential at the pixel electrode 118 in the i-th row and the first column exceeds the power supply voltage Vdd.

The drain of the TFT 116 (and the pixel electrode 118) exceeds the power supply voltage even when the scanning signal G1 is set to the high level to turn on the TFT 116, resulting in insufficient writing of the voltage corresponding to the grayscale value.

In the foregoing description, the voltage applied to the common electrode 108 increases from the voltage ComL to the voltage ComH. In a case where a positive writing is specified and the voltage applied to the common electrode 108 decreases from the voltage ComH to the voltage ComL, the voltage on the pixel electrode 118 in the i-th row and the first column decreases below the ground potential Gnd. The drain of the TFT 116 is below the power supply voltage even when the scanning signal G1 is set to the high level to turn on the TFT 116, resulting in insufficient writing of the voltage corresponding to the grayscale value.

One simple solution to avoid such a problem is to increase the voltage corresponding to the high level of a scanning signal. However, this solution may increase the complexity of the structure of a power supply circuit (not shown), and may increase the withstanding voltage of the TFT 116. The high voltage is the major cause of high power consumption.

Figure 6:
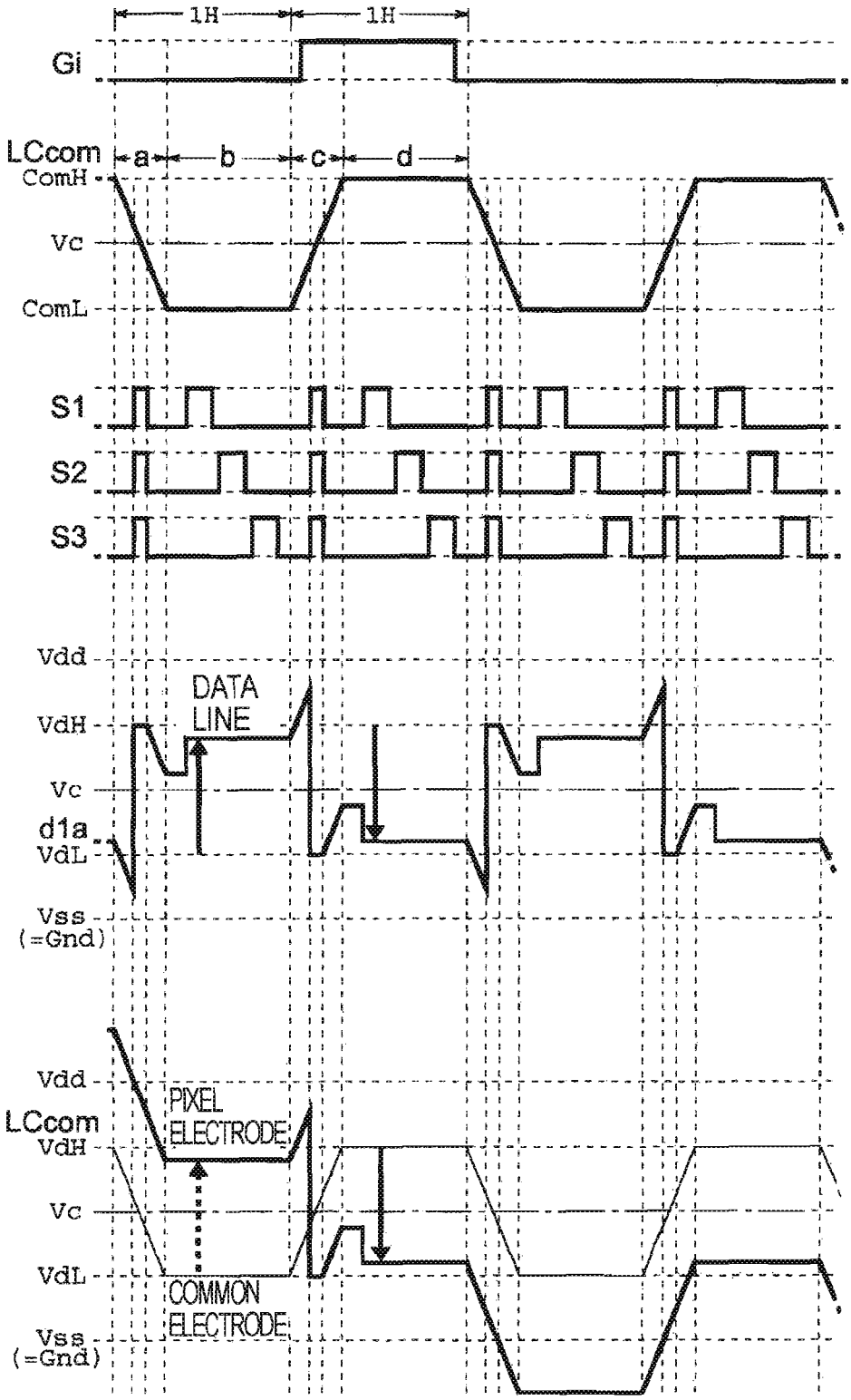
FIG. 6 is a diagram showing the voltage waveforms of the individual components of the electro-optical device.

The embodiment employs a structure in which the data lines 114 are precharged in a period in which the voltage applied to the common electrode 108 changes from one of the voltages ComL and ComH to the other. This structure prevents the high-Impedance-state data lines 114 from exceeding the power supply voltage range from the ground potential Gnd to the voltage Vdd due to the voltage change in the common electrode 108, as shown in FIG. 6, resulting in sufficient writing of the voltage corresponding to the grayscale value.

A similar advantage can also be achieved by another solution in which the data lines 114 are precharged before the end of the period b or d during which the voltage applied to the common electrode is maintained at the voltage ComL or ComH.

However, the solution in which the data lines 114 are precharged in the period during which the voltage applied to the common electrode is maintained at the voltage ComL or ComH is not appropriate for high-definition image display with a larger number of pixels. As the number of pixels increases, the number of scanning lines and the number of data lines also increase. When a vertical scanning period (1F) is constant under certain conditions and the number of scanning lines increases, one horizontal scanning period (1H) is shortened, and the increase in the number of data lines entails an increase in the number of blocks. If a precharge is performed within a limited period of time in which the voltage applied to the common electrode is maintained at the voltage ComL or ComH, the period for selecting the blocks is reduced correspondingly. Thus, a sufficient period of time for selecting the blocks is not maintained.

In the embodiment, therefore, the data lines 114 are precharged in a period during which the voltage applied to the common electrode 108 changes from one of the voltages ComL and ComH to the other, thus preventing the potential of the data lines 114 and the pixel electrodes 118 from exceeding the power supply voltage range. In the embodiment, high withstanding-voltage characteristics are not need for the TFTs 116 serving as switching elements of the pixels 110, and the scanning line driving circuit 130 needs a narrow voltage range of the scanning signals. Thus, further simplification of the structure can be achieved in addition to the reduction in the output voltage range of the D/A converters 188 by switching the voltages ComL and ComH on the common electrode 108.

Figure 8:
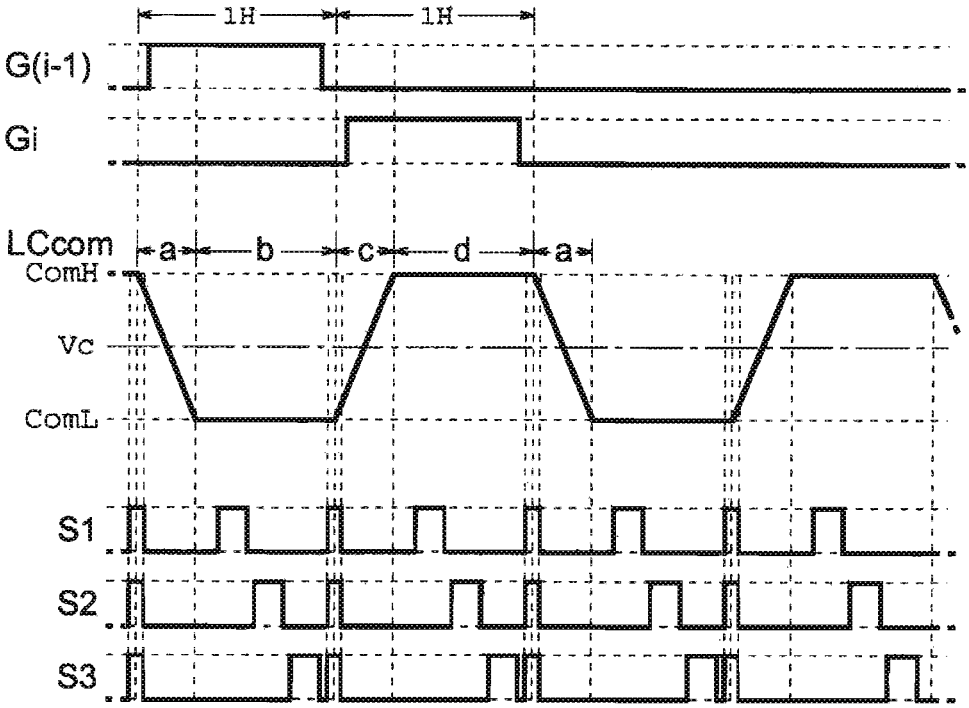
FIG. 8 is a diagram showing scanning signals, data signals, etc., according to a modification of the embodiment.
Figure 9:
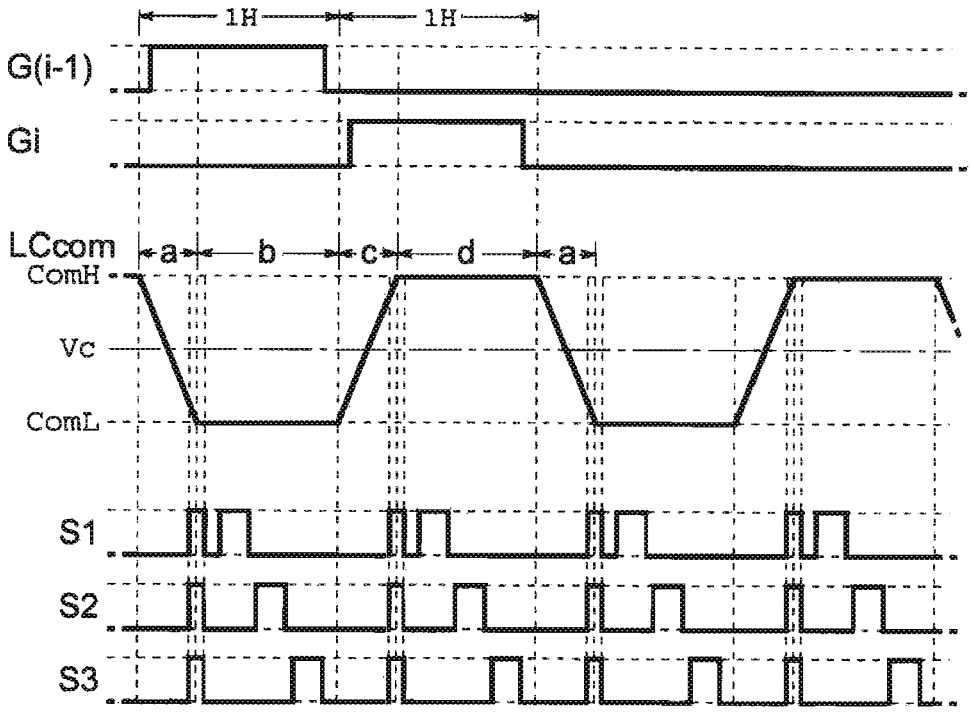
FIG. 9 is a diagram showing scanning signals, data signals, etc., according to another modification of the embodiment.

In the embodiment, a period during which the signals S1, S2, and S3 are set to the high level at the same time, that is, a period from the beginning to the end of the precharge period of the data lines 114, is fully included within a transition period during which the voltage applied to the common electrode 108 changes from one of the voltages ComL and ComH to the other. Alternatively, at least one of the beginning and the end of the precharge period may be included in the transition period of the common electrode 108 from one of the voltages ComL and ComH to the other. Specifically, as shown in FIG. 8, the start of the precharge period in response to an event in which the signals S1, S2, and S3 are set to the high level at the same time may be scheduled around the end of the period b during which the voltage applied to the common electrode 108 is maintained constant at the voltage ComL (or the period d during which the voltage is maintained constant at the voltage ComH), and the termination of the precharge period in response to an event in which the signals S1, S2, and S3 are set to the low level at the same time may be included in the period c during which the voltage applied to the common electrode 108 changes from the voltage ComH to the voltage ComL (or the period a during which the voltage changes from the voltage ComL to the voltage ComH). Alternatively, as shown in FIG. 9, the precharge period may be started around the end of the period a during which the voltage applied to the common electrode 108 changes from the voltage ComH to the voltage ComL (or the period c during which the voltage changes from the voltage ComL to the voltage ComH), and the precharge period may be terminated in the period b during which the voltage applied to the common electrode 108 is maintained constant at the voltage ComL (or the period d during which the voltage is maintained constant at the voltage ComH).

While, in the embodiment, a scanning signal is set to the high level in the middle of the period a or c, the scanning signal may be set to the high level at least in a period during which the signals S1, S2, and S3 are sequentially and exclusively set to the high level.

In the embodiment, in a precharge period, any scanning signal is set to the high level and the precharge voltage is applied to not only the data lines 114 but also the pixel electrodes 118 associated with the selected row. However, in the precharge period, any scanning signal may be set to the low level so that the precharge voltage is not applied to the pixel electrodes 118 associated with to the selected row (see, for example, FIG. 8).

In the embodiment described above, the writing polarity with respect to the same pixel is changed every vertical scanning period (that is, every frame) in order to prevent the direct-current component from being applied to the liquid crystal capacitors 120. For the same reason, the writing polarity may be inverted every two or more frames.

While the embodiment employs a normally white mode in which a white display is produced when no voltage is applied, a normally black mode in which a black display is produced when no voltage is applied may be employed.

Further, three pixels for red (R), green (G), and blue (B) may constitute one dot, and a color display may be performed.

The display area 100 is not limited to a transmissive display area, and may be reflective or transflective, which is partially transmissive and partially reflective.

Instead of sequentially selecting the blocks, the data lines 114 may be sequentially selected without being grouped into blocks. All of the data lines 114 may be selected together after they are precharged.

While, in the embodiment described above, the data lines 114 are divided into three blocks, namely, the blocks Ba, Bb, and Bc, the data lines 114 may be divided into four or more blocks depending on the number of data lines 114.

In the embodiment, the voltage corresponding to the darkest grayscale is used as a precharge voltage. The precharge voltage may be a voltage corresponding to any other grayscale level, or may be equal to the voltage ComH or ComL on the common electrode 108.

The positive and negative voltages may or may not be associated with the same grayscale level. Further, the positive and negative voltages may be the same voltage, e.g., the voltage Vc, which is a center voltage of the amplitude.

Some implementations of an electronic apparatus including the electro-optical device 10 according to the embodiment described above as a display device will be described.

Figure 10:
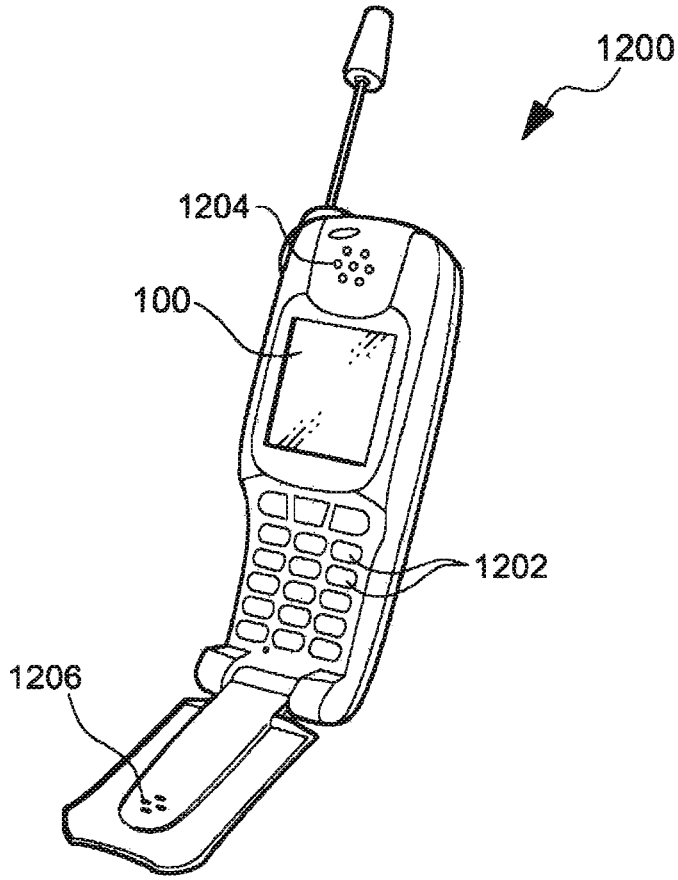
FIG. 10 is a diagram showing a structure of a mobile phone including the electro-optical device according to the embodiment.

FIG. 10 is a perspective view showing a structure of a mobile phone 1200 including the electro-optical device 10 according to the embodiment.

As shown in FIG. 10, the mobile phone 1200 includes a plurality of operation buttons 1202, an earpiece 1204, a mouthpiece 1206, and the electro-optical device 10 described above. The components of the electro-optical device 10, except for the display area 100, are provided inside the phone body, and are not exposed to the outside.

Figure 11:
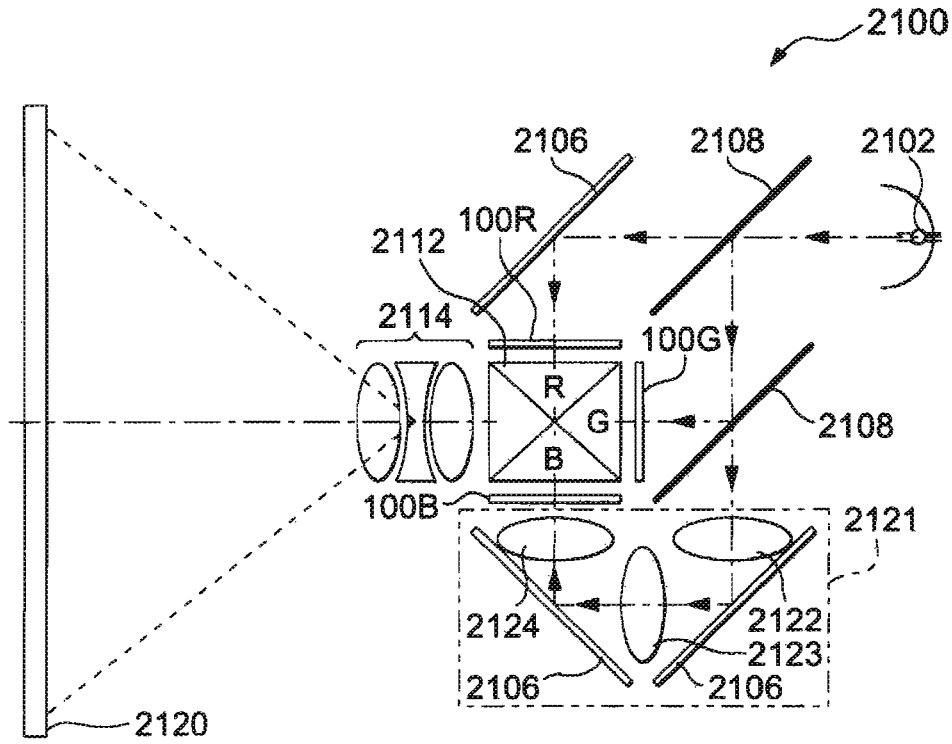
FIG. 11 is a diagram showing a structure of a projector including the electro-optical device according to the embodiment.

A three-panel projector including the electro-optical device 10 according to the embodiment described above as light valves will be described. FIG. 11 is a plan view showing a structure of a projector 2100.

The projector 2100 is provided with three mirrors 2106 and two dichroic mirrors 2108 inside thereof. Light to be incident on light valves is separated into three primary colors of red (R), green (G), and blue (B) by the three mirrors 2106 and two the dichroic mirrors 2108, and is thus directed to light valves 100R, 100G, and 100B for the respective primary colors. The light of B has a longer optical path than the light of R and the light of G, and is directed via a relay lens system 2121 formed of an incident lens 2122, a relay lens 2123, and an outgoing lens 2124 in order to prevent the optical loss.

The light valves 100R, 100G and 100B have a similar structure to that of the display area 100 of the electro-optical device 10 in the embodiment described above, and are driven by the image data corresponding to the colors of R, G, and B supplied from an external upper-level device (not shown).

The light modulated by the light valves 100R, 100G, and 100B enters a dichroic prism 2112 from three directions. In the dichroic prism 2112, the light of R and B is refracted 90 degrees while the light of G advances straightly. After images of the respective colors are combined, the resulting image is forwardly projected on an enlarged scale by a lens unit 2114, and a color image is displayed on a screen 2120.

The images transmitted through the light valves 100R and 100B are reflected by the dichroic prism 2112 before being projected, while the image transmitted through the light valve 100G is directly projected. The direction of the horizontal scanning by the light valves 100R and 100B is made opposite to the direction of the horizontal scanning by the light valve 100G so that a horizontally inverted image is displayed.

Examples of the electronic apparatus including the electro-optical device 10 include not only the mobile phone 1200 shown in FIG. 10 and the projector 2100 shown in FIG. 11 but also a digital still camera, a laptop personal computer, a liquid crystal television set, a viewfinder-type (or monitor direction-view type) videotape recorder, a car navigation system, a pager, an electronic organizer, an electronic calculator, a word processor, a workstation, a video telephone, a point-of-sale (PoS) terminal, and a device equipped with a touch panel. It is to be understood that the electro-optical device 10 described above can be used as a display device of these types of electronic apparatuses. The structure of any of the electronic apparatuses can be simplified.

What is claimed is:

1. An electro-optical device comprising:

a scan line;

a data line;

a common electrode;

a pixel electrode facing the common electrode;

a control circuit that supplies a high potential having a predetermined value and a low potential lower than the high potential alternately to the common electrode;

a scanning line driving circuit that supplies a scanning signal to the scanning line, a potential of the scanning line changes from a non-selection potential to a selection potential in a period during which the potential applied to the common electrode changes from one of the high potential or the low potential to the other of the high potential or the low potential; and a data line driving circuit that performs a precharge operation for precharging the data line after the potential of the scanning line changes from the non-selection potential to the selection potential in the period during which the potential applied to the common electrode changes from one of the high potential or the low potential to the other, and that supplies a data signal defining the grayscale levels to the data line in a period during which the scanning line is selected and during which the potential applied to the common electrode is maintained at the high potential or the low potential.

2. The electro-optical device according to claim 1, wherein the precharge operation begins and ends in the period during which the potential applied to the common electrode changes from the one of the high potential and the low potential to the other.

3. The electro-optical device according to claim 1, wherein:

the precharge operation begins in the period during which the potential applied to the common electrode changes from the one of the high potential and the low potential to the other; and the precharge operation ends in a period during which the potential applied to the common electrode is maintained constant at the other of the high potential and the low potential.

4. An electronic apparatus comprising the electro-optical device according to claim 1.

5. The electro-optical device according to claim 1, wherein during a precharge period, the control circuit applies a ramp waveform to the common electrode.

6. The electro-optical device according to claim 1, wherein the precharge operation includes supplying a positive predetermined potential or a negative predetermined potential to the data line.

7. A driving method for an electro-optical device that includes a scanning line, a data line, a common electrode, a pixel electrode facing the common electrode, and a control circuit that supplies a high potential having a predetermined value and a low potential lower than the high potential alternately to the common electrode, the driving method comprising:

supplying a scanning signal to the scanning line, a potential of the scanning line changes from a non-selection potential to a selection potential in a period during which the potential applied to the common electrode changes from one of the high potential or the low potential to the other of the high potential or the low potential;

precharging the data line after the potential of the scanning line changes from the non-selection potential to the selection potential in the period during which the potential applied to the common electrode changes from one of the high potential or the low potential to the other; and supplying a data signal defining the grayscale levels to the data line in a period during which the scanning line is selected and during which the potential applied to the common electrode is maintained at the high potential or the low potential.

* * * * *